US012227901B2

(12) United States Patent
Uil

(10) Patent No.: US 12,227,901 B2
(45) Date of Patent: Feb. 18, 2025

(54) METHOD FOR MANUFACTURING TWO-SIDED LAMINATED CARDBOARD, AS WELL AS TWO-SIDED LAMINATED CARDBOARD MANUFACTURED BY SUCH A METHOD

(71) Applicant: Eska B.V., Sappemeer (NL)

(72) Inventor: Albertus Uil, Wildervank (NL)

(73) Assignee: Eska B.V., Sappemeer (NL)

( * ) Notice: Subject to any disclaimer, the term of this patent is extended or adjusted under 35 U.S.C. 154(b) by 227 days.

(21) Appl. No.: 17/798,408

(22) PCT Filed: Feb. 10, 2021

(86) PCT No.: PCT/NL2021/050087
§ 371 (c)(1),
(2) Date: Aug. 9, 2022

(87) PCT Pub. No.: WO2021/162548
PCT Pub. Date: Aug. 19, 2021

(65) Prior Publication Data

US 2023/0084783 A1 Mar. 16, 2023

(30) Foreign Application Priority Data

Feb. 10, 2020 (NL) ..... 2024873

(51) Int. Cl.
*D21H 19/84* (2006.01)
*D21F 11/12* (2006.01)
*D21H 23/64* (2006.01)

(52) U.S. Cl.
CPC ..... *D21H 19/84* (2013.01); *D21F 11/12* (2013.01); *D21H 23/64* (2013.01)

(58) Field of Classification Search
CPC ..... D21H 19/84; D21H 23/64; D21F 11/12
See application file for complete search history.

(56) References Cited

U.S. PATENT DOCUMENTS 4,500,381 A 2/1985 Nordstrom
6,228,222 B1 * 5/2001 Meschenmoser ..... D21F 3/0218 162/358.3

(Continued)

FOREIGN PATENT DOCUMENTS

DE 102007022241 A1 * 11/2008 ..... D21F 7/02
EP 2679527 A1 1/2014
JP 2018012195 A 1/2018

OTHER PUBLICATIONS

International Search Report and Written Opinion—PCT/NL2021/050087—mailing date Aug. 19, 2021.

*Primary Examiner* — Jacob T Minskey
*Assistant Examiner* — Stephen M Russell
(74) *Attorney, Agent, or Firm* — Banner & Witcoff, Ltd.

(57) ABSTRACT

In manufacturing two-sided laminated cardboard (1) in a laminating apparatus (10), by controlling band tensions of a first outer layer (11) and a second outer layer (12), a torque difference between an exerted first torque (Q1) in an upper roller (21) and an exerted second torque (Q2) in a lower roller (22) is controlled towards a pre-determined value (ΔQ) of said torque difference, while at the same time a torque addition sum of the first torque and the second torque is controlled towards a pre-determined constant value (Q) of said torque addition sum. Thus the invention provides an effective and reliable solution for counteracting concaveness or convexness, in the conveying direction (MD), of the two-sided laminated cardboard (1) to be manufactured.

2 Claims, 1 Drawing Sheet

(56) References Cited

U.S. PATENT DOCUMENTS

| | | | | |
|---|---|---|---|---|
| 2003/0015109 | A1 | 1/2003 | Glockner et al. | |
| 2011/0195231 | A1* | 8/2011 | Lai | B32B 7/05 428/186 |
| 2014/0000785 | A1 | 1/2014 | Gnan et al. | |

* cited by examiner

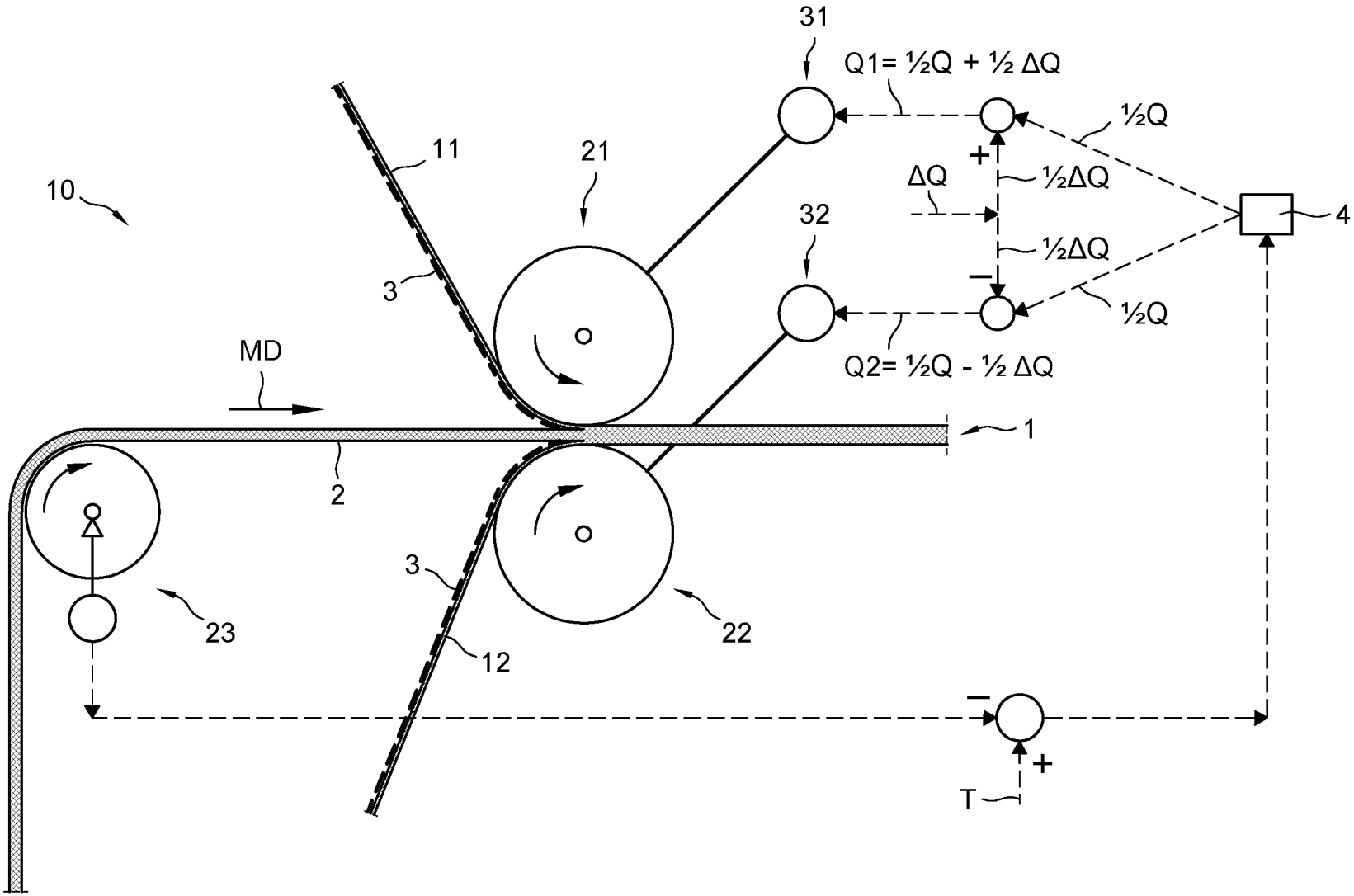
4
½Q
½Q
½ΔQ
½ΔQ
Q1= ½Q + ½ ΔQ
Q2= ½Q - ½ ΔQ
+
−
ΔQ
1
+
−
T
31
32
22
21
11
3
12
3
2
MD
23
10

METHOD FOR MANUFACTURING TWO-SIDED LAMINATED CARDBOARD, AS WELL AS TWO-SIDED LAMINATED CARDBOARD MANUFACTURED BY SUCH A METHOD

CROSS-REFERENCE TO RELATED APPLICATIONS

This application is a U.S. National Stage application under 35 U.S.C. § 371 of International Application PCT/NL2021/050087 (published as WO 2021/162548 A1), filed Feb. 10, 2021 which claims the benefit of priority to Application NL 2024873, filed Feb. 10, 2020. Benefit of the filing date of these prior applications is hereby claimed. Each of these prior applications is hereby incorporated by reference in its entirety.

The invention relates to a method for manufacturing two-sided laminated cardboard, wherein on both sides of an intermediate cardboard layer a first outer layer and a second outer layer, respectively, are laminated. According to the invention the first outer layer and/or the second outer layer can be manufactured from various materials, such as for example paper, cardboard or synthetic material. The invention further relates to two-sided laminated cardboard manufactured by such a method.

From practice a method is known according to the pre-characterizing portion of the appended independent claim 1, i.e. a method for manufacturing two-sided laminated cardboard, wherein on both sides of an intermediate cardboard layer a first outer layer and a second outer layer, respectively, are laminated, and wherein during said laminating:

- the intermediate layer is conveyed in a conveying direction through a laminating apparatus;
- the first outer layer is glued together with the upper side of the intermediate layer by means of a rotating upper roller under exertion of a first torque, and the second outer layer is glued together with the lower side of the intermediate layer by means of a rotating lower roller under exertion of a second torque;
- a measuring roller measures a measured band tension, in the conveying direction, of the intermediate layer being conveyed;
- for the purpose of a taut running of the intermediate layer, the intermediate layer being conveyed is kept at a pre-determined constant operational band tension in the conveying direction in dependence of said measured band tension and in dependence of said pre-determined constant operational band tension; and
- for the purpose of counteracting concaveness or convexness, in the conveying direction, of the two-sided laminated cardboard to be manufactured, band tensions of the first outer layer and the second outer layer are controlled.

An important parameter in the production and processing of laminated cardboard is the degree into which a cardboard is lying flat. A bad flatness degree of a cardboard hampers the conveyance of the cardboard in processing machines, as well as the conveyance of the eventual product.

Laminated cardboard can unintentionally be curved (concaveness/convexness) in conveying direction (MD), in transverse direction (CD) or in a direction in-between MD and CD (Warp). For preventing concaveness or convexness in the transverse direction CD in case of outer laminating layers made from paper, control in CD commonly takes place by controlling fiber direction of the laminating papers and by symmetry in humidity level of the laminating papers and the intermediate cardboard layer.

For preventing concaveness or convexness in MD (the conveying direction), control in MD commonly takes place by controlling the band tensions of the laminating papers by means of brakes at the unrolling of the laminating papers. Herein, however, some adverse side effects occur, which is explained as follows. The adhesive applicator, which is situated between the unroller and the laminating press, increases the band tensions dependent on various factors. Controlling the band tensions for controlling the flatness can change the adhesive application instruction, while controlling the adhesive application instruction on its turn changes the band tensions again. At higher band tensions and thin outer paper layers there is increased risk of band breakage of the wet outer paper layers having been glued. Low band tension, on the other hand, can cause loss of grip at the spreader roll, which results into pleats.

It is an object of the invention to provide an alternative solution for preventing concaveness or convexness, in the conveying direction, of the two-sided laminated cardboard to be manufactured, wherein the occurrence of the above-mentioned adverse side effects is counteracted.

For that purpose the invention provides a method according to the appended independent claim 1, as well as a two-sided laminated cardboard according to the appended independent claim 2.

Hence, the invention provides a method for manufacturing two-sided laminated cardboard, wherein on both sides of an intermediate cardboard layer a first outer layer and a second outer layer, respectively, are laminated, and wherein during said laminating:

- the intermediate layer is conveyed in a conveying direction through a laminating apparatus;
- the first outer layer is glued together with the upper side of the intermediate layer by means of a rotating upper roller under exertion of a first torque, and the second outer layer is glued together with the lower side of the intermediate layer by means of a rotating lower roller under exertion of a second torque;
- a measuring roller measures a measured band tension, in the conveying direction, of the intermediate layer being conveyed;
- for the purpose of a taut running of the intermediate layer, the intermediate layer being conveyed is kept at a pre-determined constant operational band tension in the conveying direction in dependence of said measured band tension and in dependence of said pre-determined constant operational band tension; and
- for the purpose of counteracting concaveness or convexness, in the conveying direction, of the two-sided laminated cardboard to be manufactured, band tensions of the first outer layer and the second outer layer are controlled;

characterized in that in said controlling of said band tensions of the first outer layer and the second outer layer:

- a torque addition sum of the first torque and the second torque is controlled towards a pre-determined constant value of said torque addition sum, said pre-determined constant value being obtained from experience; and
- a torque difference between the first torque and the second torque is controlled towards a pre-determined value of said torque difference, said pre-determined value of said torque difference being obtained from experience, while maintaining said controlling of said torque addition sum towards said pre-determined constant value of said torque addition sum.

Concisely worded, the invention therefore relates to a concaveness/convexness control in the conveying direction, wherein said concaveness/convexness control is based on applying a torque difference control for the upper and lower rollers while keeping the total torque of the torques of both rollers equal.

According to this torque difference control, wherein total torque is kept equal, it is for example possible to increase the first torque of the upper roller and simultaneously decrease the second torque of the lower roller by a same value, whereby the upper first outer layer is glued to the intermediate layer with decreased MD tension, and the lower second outer layer is glued to the intermediate layer with increased MD tension. This difference in tension results into a bulging correction for counteracting an undesirable concave shape of the 3-layered end product. Conversely, the first torque of the upper roller can be decreased and the second torque of the lower roller can be simultaneously increased by a same value, whereby the upper first outer layer is glued to the intermediate layer with increased MD tension, and the lower second outer layer is glued to the intermediate layer with decreased MD tension. This tension difference results into a hollowing correction for counteracting an undesirable convex shape of the 3-layered end product. Such simultaneous, but mutually opposite, ways of controlling the upper roller and the lower roller, make that the total of the two torques of the two rollers remains equal.

Thanks to using the torque difference control, wherein total torque is kept equal, the invention provides an effective corrective flatness control, wherein a corrective control action has no consequences for band running and band tension of the intermediate cardboard layer, and wherein the pleat and breakage risk of the glued outer layers is minimized.

Hereinafter the invention is further elucidated with reference to a non-limiting example embodiment, and with reference to the schematical FIG. 1 in the appended drawing.

FIG. 1 schematically shows, in side view, an example of a part of a laminating apparatus during execution of an example of an embodiment of a method for manufacturing two-sided laminated cardboard according to the invention.

FIG. 1 further comprises a control scheme for executing the concerned example of the method. This control scheme is formed by dash line arrows which are connecting a number of measuring and control symbols with one another. In the control scheme, the highly schematically depicted part 4 is a PID controller which uses set values and measured values that play a role in the method according to the invention.

FIG. 1 shows the laminating apparatus 10 for manufacturing two-sided laminated cardboard 1, wherein on both sides of the intermediate cardboard layer 2 the first outer layer 11 and the second outer layer 12, respectively, are laminated by means of gluing with glue 3. During laminating the intermediate layer 2 is conveyed through the laminating apparatus 10 in the conveying direction MD. Therein, the first outer layer 11 is glued by means the upper roller 21 at the upper side of the intermediate layer 2, and the second outer layer 12 is glued by means of the lower roller 22 at the lower side of the intermediate layer 2. The upper roller 21 is driven by the shown first motor 31, under exertion of a first torque Q1. The lower roller 22 is driven by the shown second motor 32, under exertion of a second torque Q2. The shown measuring roller 23 measures the band tension, in the conveying direction MD, of the intermediate layer 2 being conveyed.

For the purpose of a taut running of the intermediate layer 2 the intermediate layer 2 is kept at the pre-determined constant operational band tension T in the conveying direction MD. This is controlled in dependence of the band tension measured by the measuring roller 23 and in dependence of the pre-determined constant operational band tension T.

For the purpose of counteracting concaveness or convexness in the conveying direction MD of the two-sided laminated cardboard 1 to be manufactured, the band tensions of the first outer layer 11 and the second outer layer 12 in the conveying direction MD are controlled. Therein, the addition sum Q1+Q2 of the first torque Q1 and the second torque Q2 are controlled towards the pre-determined constant value Q. In other words, the control is such that eventually Q1+Q2=Q applies. Therein, also the torque difference between the first torque Q1 and the second torque Q2 is controlled towards the pre-determined value ΔQ of said torque difference, while maintaining said controlling of said torque addition sum towards said pre-determined constant value Q. As seen in FIG. 1, this is realized in the shown example in that the torque Q1 of the first motor 31 is controlled towards ½Q+½ΔQ, and the torque Q2 of the second motor 32 is controlled towards ½Q−½ΔQ. Accordingly, in the shown example the torque addition sum Q1+Q2 and the torque difference Q1−Q2 are controlled as follows:

$$Q1+Q2=(\tfrac{1}{2}Q+\tfrac{1}{2}\Delta Q)+(\tfrac{1}{2}Q-\tfrac{1}{2}\Delta Q)=Q, \text{ and}$$

$$Q1-Q2=(\tfrac{1}{2}Q+\tfrac{1}{2}\Delta Q)-(\tfrac{1}{2}Q-\tfrac{1}{2}\Delta Q)=\Delta Q.$$

It has appeared that, thanks to using this "torque difference control, wherein total torque is kept equal", a practically realizable and effective corrective flatness control is obtained, wherein a corrective control action has no consequences for band running and band tension of the intermediate cardboard layer, and wherein the pleat and breakage risk of the glued outer layers is minimized.

The invention claimed is:

1. A method for manufacturing two-sided laminated cardboard, wherein on both sides of an intermediate cardboard layer a first outer layer and a second outer layer, respectively, are laminated, and wherein during said laminating:

the intermediate layer is conveyed in a conveying direction through a laminating apparatus;

the first outer layer is glued together with the upper side of the intermediate layer by means of a rotating upper roller under exertion of a first torque, and the second outer layer is glued together with the lower side of the intermediate layer by means of a rotating lower roller under exertion of a second torque;

a measuring roller measures a measured band tension, in the conveying direction, of the intermediate layer being conveyed;

for the purpose of a taut running of the intermediate layer, the intermediate layer being conveyed is kept at a pre-determined constant operational band tension in the conveying direction in dependence of said measured band tension and in dependence of said pre-determined constant operational band tension; and for the purpose of counteracting concaveness or convexness, in the conveying direction, of the two-sided laminated cardboard to be manufactured, band tensions of the first outer layer and the second outer layer are controlled;

wherein in said controlling of said band tensions of the first outer layer and the second outer layer:

a torque addition sum of the first torque and the second torque is controlled towards a pre-determined constant value of said torque addition sum, said pre-determined constant value being obtained from experience; and a torque difference between the first torque and the second torque is controlled towards a pre-determined value of said torque difference, said pre-determined value of said torque difference being obtained from experience, while maintaining said controlling of said torque addition sum towards said pre-determined constant value of said torque addition sum.

2. A two-sided laminated cardboard, manufactured by the method according to claim 1 in said laminating apparatus.

* * * * *